United States Patent [19]

Hull

[11] 4,366,081

[45] Dec. 28, 1982

[54] MIXING APPARATUS FOR FOAM GENERATION

[76] Inventor: Donald A. Hull, 6660 Woodman Ave., #105, Van Nuys, Calif. 91405

[21] Appl. No.: 148,563

[22] Filed: May 9, 1980

[51] Int. Cl.[3] ..... B01F 3/04; B01F 5/06; B01F 13/06

[52] U.S. Cl. ..... 252/359 E; 239/343; 239/346; 261/DIG. 26; 366/336

[58] Field of Search ..... 252/359 R, 359 A, 359 D, 252/359 E; 366/336, 338, 339; 134/36; 261/DIG. 26; 239/343, 346, 370; 422/133; 222/195

[56] References Cited

U.S. PATENT DOCUMENTS

| | | | |
|---|---|---|---|
| 1,457,895 | 6/1923 | Campanella | 239/343 |
| 2,585,092 | 2/1952 | Conto | 252/359 E |
| 2,715,045 | 8/1955 | Thompson | 252/359 E |
| 2,864,714 | 12/1958 | Dixon et al. | 261/DIG. 26 |
| 3,337,195 | 8/1967 | Farison | 261/DIG. 26 |
| 3,430,865 | 3/1969 | McDougall | 261/DIG. 26 |
| 3,618,713 | 11/1971 | Batchelor | 261/DIG. 26 |
| 3,853,784 | 12/1974 | Rogers | 252/359 E |
| 4,133,773 | 1/1979 | Simmons | 252/359 E |

FOREIGN PATENT DOCUMENTS

| | | | |
|---|---|---|---|
| 11381 | 5/1980 | European Pat. Off. | 252/359 E |
| 206375 | 9/1979 | Fed. Rep. of Germany . | |

*Primary Examiner*—Bradley Garris
*Attorney, Agent, or Firm*—Don B. Finkelstein

[57] ABSTRACT

A device for generating a foam which might be used, for example, as a cleaning fluid. As depicted, the device comprises structure which accepts a combined fluid, such as water, soap, and air, and passes it through a pair of turbulators in series. As it enters the first turbulator, the fluid is forced to turn through a turbulence-generating angle. The first turbulator may be substantially filled with a turbulence-generating material providing a plurality of randomly sized and randomly oriented interstices through which the fluid must pass in traversing the turbulator. The turbulence-generating material might, for example, comprise a material such as metallic or plastic turnings which are gathered together and fixed in place. Fluid discharged from the first turbulator then travels in a relatively quiescent flow through a pipe or tube to a second turbulator which may employ the same type of material to generate additional turbulence in the flow and thus assure complete mixing. Preferably, the material in the second turbulator is packed at about the same density as that in the first turbulator, but the second turbulator has a larger volume to allow the foam to expand.

18 Claims, 3 Drawing Figures

MIXING APPARATUS FOR FOAM GENERATION

BACKGROUND OF THE INVENTION

The present invention relates to a device for thoroughly mixing a plurality of elements or materials which are in a combined fluid flow. More specifically, it is currently envisioned that a device formed in accordance with the present invention will be utilized to combine fluids such as water, soap, and air to generate a high quality, relatively dry cleansing foam which might be used, for example, to clean vehicles, walls, etc. In other words, it is intended that the invention be capable of producing a relatively dry foam which remains dry even when it is moved a long distance from the generator. Nevertheless, it will be realized by those skilled in the art that the invention can be employed to thoroughly mix any combined fluid, regardless of the ultimate use of the fluid. For most purposes, however, it will be preferred that the foam be as dry as possible, i.e., have maximum expansion. In other words, if, for example, a foam is to be used as a car washing agent, it is preferred that the foam be as dry (expanded) as possible when it reaches the washing brush or application tool.

For the purposes of this disclosure, a combined fluid will be considered to be any fluid having distinct elements, e.g., soap, air, and water, which are inefficiently or not well mixed.

In the past, a wide variety of devices have been developed to mix the distinct elements in a combined fluid for one purpose or another. Such devices have often employed pumps, mixing tanks, turbulence-generating structures and machinery, etc. In most instances, the devices produced marginally satisfactory mixing, were relatively expensive, or required relatively large amounts of chemicals and/or air to produce the desired foam. In some cases, even if a good, relatively dry foam was produced, the structure was such that the foam became compressed and very wet prior to reaching the point of its use. Finally, some prior art mixers require the use of structural production materials which cause the devices to require frequent maintenance in order to produce a consistent fluid mixture.

One application for such a mixing device has recently been found in car washes and, more particularly, in self-service car washes in which the owner of the car uses a brush, mounted on a wand, to spread and rub a cleaning fluid on his car. In those applications, the car wash builder and/or owner usually provides a source of water mixed to some extent (usually poorly) with a soap. This fluid can be discharged through the wand and applied to the surface of the car to be washed. In most cases, the soap is drawn through a venturi or similar device into the water as the water passes the soap reservoir. This results in an inefficient mixture containing very little, if any, cleansing foam. Consequently, customers of such car washes are relatively dissatisfied with the results they achieve and often must pay for successive uses of the machine for a single washing. When this occurs, the customer usually does not patronize that establishment again.

As a result, a need has arisen for a device which can be utilized to mix a combined fluid, such as soap and water, preferably with air, to produce an efficiently or thoroughly mixed fluid in the form of a rich, dry, cleansing foam in a simple, economical, maintenance-free manner.

SUMMARY OF THE INVENTION

The present invention relates to a mixing device which may be employed to thoroughly mix a combined fluid. As stated previously, as the term used in this document, a combined fluid may be considered to be a fluid made up of several distinct fluids or elements which are inefficiently and/or ineffectively mixed. In its currently envisioned use, the invention may be employed, for example, to produce a thorough and efficient mixture of air, water, and cleaning fluid. The thoroughness of the mixture will be evidenced, for example, by the production of a high quality foam which may be used as a cleaning agent for automobiles, walls, floors, or any other object to be cleaned.

In its most basic sense, it is currently envisioned that the invention may be employed in an apparatus for generation of relatively severe turbulence in a combined fluid as it travels toward the application tool for delivery to the object to be cleaned.

In its presently preferred embodiment, the device comprises a flow control system having two turbulators. The first turbulator, which receives a combined fluid of soap, air, and water, accepts the fluid in such a manner that the fluid enters the turbulator by being turned through a turbulence-generating angle. It is presently preferred that the angle be approximately 90°, although any angle which will cause the fluid to enter into turbulant flow may be employed. It is preferred, of course, that the turbulence be maximized utilizing readily available materials.

The first turbulator comprises a predetermined volume which is substantially filled with a structure which produces a large plurality of randomly sized and randomly oriented interstices through which the fluid must pass. For example, the material in the turbulator could be a commonly available plastic or metallic pot and pan scrubbing pad comprising a randomly oriented group of thin, flexible turnings, or any device having a similar configuration. Such devices resemble, for example, metal lathe cuttings which are tightly interwoven and twisted together. In any event, the turbulence-generating material in the first turbulator will cause the total fluid to be broken up into a substantial number of distinct flows, each of which passes through an interstice. The distinct flows will be combined with other flows after passing through each opening, and then will be re-divided as they travel through the next openings. Thus, the fluid will be continuously broken up and recombined, generating a very thorough mixture.

As the fluid is discharged from the first turbulator, it preferably travels upwardly in a relatively quiescent flow and enters a second turbulator in which the process is repeated in a similar turbulence-creating material. When the fluid is discharged from the second turbulator, it may be transferred to the application tool for the desired use.

In the embodiment which is presently preferred, the direction of travel between the turbulators will be substantially vertical so that a foam which is generated in the first turbulator will flow upwardly and not become trapped within the system and will have a natural flow which will resist compression. Also, the porous material in the second turbulator will preferably be packed at about the same density as that in the first turbulator. However, it is preferred that the volume within the second turbulator be larger than that in the first turbulator in order to allow continued expansion of the foam.

This relationship of the sizes, or average size, of the interstices will insure the production of a thorough mixture and the discharge of a high quality foam from the second turbulator. Thus, the foam fluid discharged from the first turbulator will be more thoroughly broken up and mixed in the second turbulator to improve the foam quality.

Upon review of the following Detailed Description, taken together with the accompanying drawings, those skilled in the art will realize that the present invention may be employed in a wide variety of embodiments, many of which may not even resemble that described and depicted here. Nevertheless, it should be borne in mind that the description and accompanying drawings are merely illustrative of the principles of the present invention and only set forth the best mode presently known for accomplishing it. They are not intended to be limiting to the scope of the invention which is defined and limited only by the appended claims.

DETAILED DESCRIPTION

Figure 1:
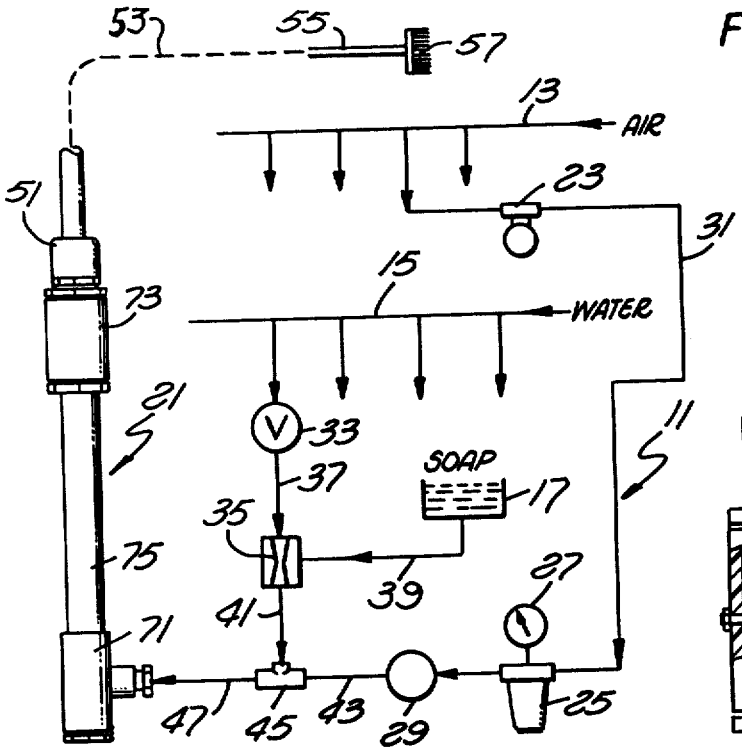
FIG. 1 comprises a schematic illustration of a mixing system employing a device utilizing the present invention.

Referring now to FIG. 1, the preferred embodiment of the present invention is depicted as a part of a schematically illustrated system 11 including an air source 13, a water source 15, and a cleaning fluid or soap source 17. As depicted, the air and water sources may comprise manifolds or headers to which a large number of foam generators, one of which is illustrated at 21 may be connected. Thus, air from the manifold 13 may be passed through a control valve 23, a pressure regulator valve 25 having a gauge 27, and a check valve or one-way flapper valve 29, via a pipe or a tube 31. Similarly, the water in manifold 15 may be passed through a pressure control valve 33 and a venturi 35, via a line 37. The soap may flow through a line 39 under the force of gravity, for example, to the venturi 35. Thus, the soap will be entrained into the water, forming a combined fluid which is relatively poorly mixed. The combined fluid of water and soap may then move through a line 41; the air may pass through a line 43; the two fluid may then combine in a "T" 45 which may, if desired, be formed so as to also produce a venturi effect. The combined fluid of air, water, and soap will then pass through a line 47 to the foam generator 21.

The foam discharged from the foam generator, which will be more completely described below, may pass through a line 53 which, preferably, is at least partly flexible near its outer end, to a cleaning tool 55. The tool may, for example, include a brush 57 through which foam will be forcibly discharged for use as a cleaning agent.

It should be realized by those skilled in the art that the system depicted in FIG. 1 may be employed with a substantial number of foam generators. For example, if such a system were employed in a self-service car wash, a generator could be provided for each bay, with all generators being fed from a single air manifold, a single water manifold, and/or a single soap reservoir. In other words, the number of generators which can be serviced by the fluid sources is limited only by the amount of pressure or suction which can be exerted upon the fluid in each of the sources to ensure the proper production of a combined fluid.

Figure 2:
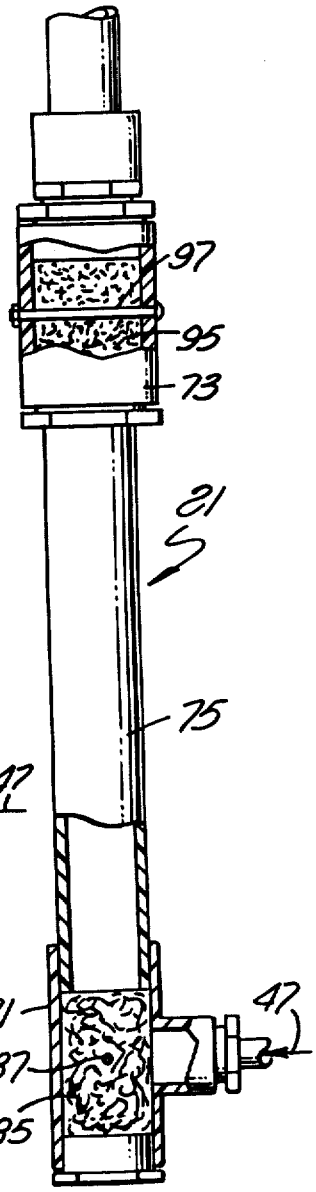
FIG. 2 comprises an enlarged view of the mixing apparatus depicted in the system of FIG. 1.

Referring now to FIG. 2, the foam generator 21 is shown in greater detail as including the first turbulator-expansion chamber 71, a second turbulator-expansion chamber 73, and a pipe or tube 75 extending between and connecting the turbulators for fluid communication and serving as an intermediate expansion chamber for foam being discharged from the first turbulator.

Figure 3:
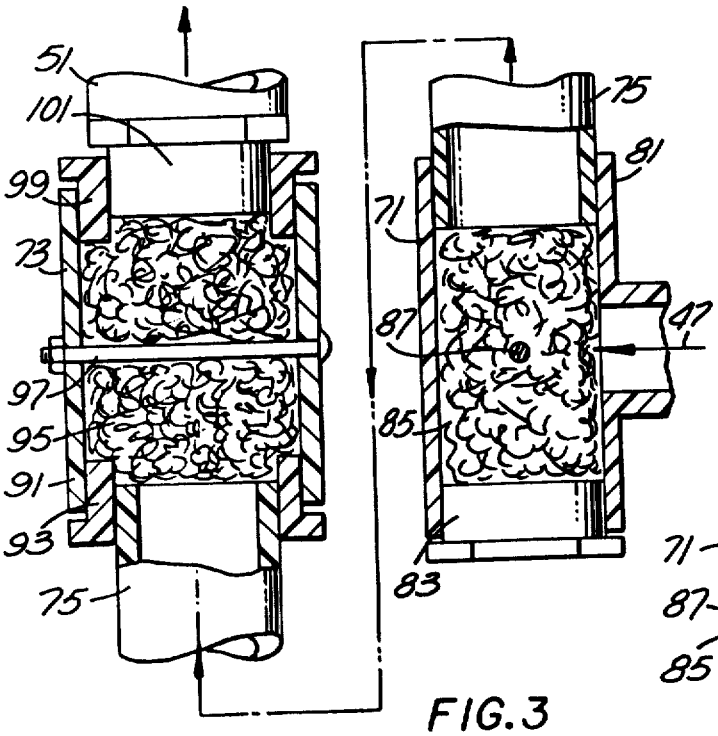
FIG. 3 comprises a further enlarged view of the turbulators employed in the mixing apparatus.

Referring to the greater detail shown in FIG. 3, it can be seen that the first turbulator 71 may, for example, comprise a "T" 81 having a plug 83 properly sealed in one end thereof, and the pipe 75 sealed in the other end thereof. The line 47 preferably comprises the perpendicular leg of the "T" so that fluid entering the "T" is forced to make a sharp, approximately 90°, turn as it enters and passes through the "T" toward the pipe 75.

Although in each of the figures, the angle of fluid travel change at the first turbulator is approximately 90°, it should be understood that any suitable angle which will generate turbulence in the fluid will be acceptable; the only requirement is that it is preferred that as much turbulence be generated as possible. In most instances, the 90° will be selected simply because most readily available parts are formed at that angle. In any event, the cross-sectional area of turbulator 71 is, preferably, greater than that of line 47 so that the turbulator also acts as a first foam expansion chamber. As shown in the drawing, each expansion chamber is uniform in cross-sectional area and has a predetermined volume. Thus the fluid from line 47 will expand into turbulator 71, then into the larger diameter turbulator 73. In this manner, the device preferably provides three distinct expansion stages.

Within the turbulator 71, a turbulence-generating material 85 may be provided which, preferably, may be held in place by any suitable means, such as a bolt 87 which passes through the walls of the turbulator as illustrated.

In the presently preferred embodiment, the turbulence-generating material 85 may comprise, or resemble, a plastic or metallic device such as a pot and pan scrubbing pad or cleaner. A commonly available product which resembles the preferred materials is available under the trademark "CHORE GIRL." It will be recalled that such pads resemble a "ball" of metal lathe or milling machine cuttings or turnings, each individual cutting being very long and tightly curled.

The material 85 may be packed within the volume of the "T" 81 in the position illustrated, thus providing a large plurality of interstices which are randomly oriented and randomly sized. With this structure, fluid entering the "T" through the line 47 will be broken up into distinct flows, or units of flow, each unit passing through a different interstice. Each flow unit will collide and combine with adjacent flow units and the combined flow units will again be re-divided, broken up, divided again, etc., until the fluid reaches the pipe 75 and is discharged from the turbulator. As a result, the combined fluid entering the turbulator 71 will undergo a significant amount of turbulence, both as a result of the turbulence-generating angle change of flow direction, as well as the severe turbulence generated by the material 85. If the entering fluid includes air, the discharged fluid will be in the form of a foam. However, even though this foam will comprise a much better fluid mixture than can be found at the turbulator 71 intake, it will still be rather wet and somewhat compressed.

As the high quality, but wet, foam enters the pipe-expansion chamber 75, the flow will be relatively quiescent, compared to the turbulence within the turbulator. Preferably, the generator 21 will be substantially vertically oriented to take advantage of the natural tendency of the foam to travel upwardly and expand through the pipe 75 toward a second turbulator 73. Consequently, none of the fluid will have an opportunity to be trapped anywhere within the generator. Since this vertical orientation will allow the foam to expand as it is discharged from the turbulator 71, and since there is nowhere for the foam to become trapped, little or no foam compression will take place in the pipe. Stated in other words, the foam quality improvement which occurs due to the turbulator 71 will not be degraded by compression of the foam as it passes through pipe 75.

The pipe 75 may be used in the manner shown to transfer the premixed, wet foam fluid into the interior volume of a nipple or coupling 91 of a second turbulator 73. As illustrated, the pipe 75 may be sealed to the coupling 91 by means of an intermediate coupling 93. In any event, the interior of the coupling 91 may be provided with a turbulence-generating material 95 similar to material 85 in the first turbulator. The material 95 may be held within the second turbulator 73 by any suitable means, such as a bolt 97 which is fixed to the wall of the coupling 91 as illustrated in FIG. 3.

Preferably, the internal diameter of turbulator 73 is greater than that of either pipe 75 or the first turbulator 71. The turbulence-generating material 95 is preferably at about the same density as the material 85 in turbulator 71, thus allowing turbulator 73 to act as both a further expansion chamber and a fluid mixer. In other words, turbulator 73 will not restrict the fluid discharged from pipe 75 and no foam compression will occur in that turbulator even though it contains turbulence-generating material 95. The interstices of material 95 will be about the same size as those of material 85, although there will be about twice as many of them. As a result, material 95 will serve to allow or cause further expansion and drying of the foam. Consequently, the fluid leaving the second turbulator, via a coupling 99 and a nipple 101 which directs the fluid toward the discharge line 51 will be a very high quality foam which is an excellent cleansing agent.

Simply of way of illustration, it is presently envisioned that the amount of turbulence-generating material 95 in turbulator 73 will be approximately twice the amount of material 85 in the turbulator 71, whether by volume or by weight. Thus, if the interior volume of the second turbulator 73 is twice that of the first turbulator 71, the amount of material 95 may be twice that of material 85 and no flow restriction will be created. Through experimentation, it has been found that this is the optimum ratio of material to produce a high quality foam, although any ratio between 1.5 to 1 and 2.5 to 1 might be acceptable. In fact, it is quite possible that the ratio may well be modifiable in accordance with the volume of air, water, and/or soap in a selected combination, or even the particular type of soap used.

In use, the owner of the system may desire to control the air and water pressures in accordance with the water quality and hardness, as well as in accordance with the quality of the soap. Also, the air pressure may be controlled in order to select an optimum wetness of the foam. It has been found that the preferred air pressure is often between 20 and 40 PSI for generation of the soap foam. The higher the pressure, of course, the dryer the foam will be.

In one experimental system which has been constructed, the second turbulator was arranged so as to have twice the volume and amount of turbulence-generating material as the first turbulator. For example, material 95 weighed ½ ounce and material 85 weighed ¼ ounce. Pipe-expansion chamber 75 had a 1" inner diameter, and pipe or flow line 53 had a ½" inner diameter. During testing it was found that little or no foam compression occurred in line 53 even though the foam was thus transported a greater distance than possible with any known prior art device. In other words, a very dry foam was discharged at the applicator 57. Of course, if longer transport distances are necessary, it may be necessary to use a discharge line having an inner diameter greater than ½". Alternatively (or additionally), the transport distance (i.e., line 53) may be increased by increasing the air pressure. Thus, even if some foam compression may occur, the finally discharged foam will still be high quality and relatively dry.

If a mixing device which is formed in accordance with the present invention is used to generate a cleansing foam, the amount of soap or cleaning fluid which must be employed will be minimized. In other words, the present invention results in a highly efficient foam generator which minimizes the volume of expensive soaps and cleaning agents for the purpose described.

Having now reviewed this Detailed Description and the drawing of the presently preferred embodiment, those skilled in the art will realize that these merely constitute an introduction to the invention rather than its delimitation. It must be kept in mind that the scope of the invention, as set forth in the following claims, is broad enough to encompass a substantial number and wide variety of embodiments, many of which may not even resemble that depicted and described here. Nevertheless, such additional embodiments will employ the spirit and scope of the invention which will be established only by the following claims.

I claim:

1. Apparatus for generating a foam comprising:

air inlet means;

means operatively connected to the air inlet means for combining a liquid with air passed therethrough;

means operatively connected to the air inlet means for combining a cleaning fluid with the liquid and the air;

expansion chamber inlet means for receiving the combined fluid;

first expansion chamber means operatively connected to the expansion chamber inlet means for creating a mixing turbulence in the flow of the combined fluid of air, liquid, and cleaning fluid including means for altering the direction of flow of the combined fluids by approximately 90° as they flow through the first expansion chamber means;

second expansion chamber means comprising flow means through which the combined fluids flow away from the turbulence creating means in a relatively quiescent flow; and third expansion chamber means in fluid communication with the second expansion chamber means and including means therein for creating a mixing turbulence in the flow of the combined fluid of air, liquid, and cleaning fluid, and said third expansion chamber means is so configured as to be of greater volume than the first expansion chamber means.

2. The apparatus of claim 1 wherein the mixing turbulence creating means comprises porous material having randomly sized and randomly oriented interstices therein.

3. The apparatus of claim 2 wherein the first expansion chamber also includes a porous material having having randomly sized and randomly oriented interstices therein, and the porous material in the first and third expansion chamber means is arranged to be of approximately the same density and have, on the average, the same size interstices.

4. The apparatus of claim 3 wherein the amount by weight of material in the third expansion chamber relative to that in the first expansion chamber is approximately 2.0 to 1.

5. Apparatus for generating a thoroughly mixed fluid comprising:

a fluid inlet;

a first turbulator, so sized relative to the fluid inlet as to form a first expansion chamber, for receiving fluid from the inlet including a porous material therein having randomly sized and randomly oriented interstices therein, the material being so positioned relative to the fluid inlet that fluid passing through the inlet must pass through a plurality of interstices in the porous material;

means forming a relatively smooth expansion flow path for fluid which has traversed the first turbulator;

a second turbulator, so sized relative to the expansion flow path as to form a third expansion chamber, for passage of a fluid therethrough including a porous material therein having randomly sized and randomly oriented interstices therein, the material being so positioned relative to the expansion flow path that fluid passing therethrough must pass through a plurality of interstices in the porous material, the porous material in the second turbulator comprising a material similar to the porous material in the first turbulator and having, on the average, the same size interstices, but of a larger number, than the material in the first turbulator; and a fluid outlet operatively connected to the second turbulator.

6. The apparatus of claim 5 wherein the porous material in the second turbulator is approximately as densly packed as that in the first turbulator.

7. The apparatus of claim 5 or 6 wherein the amount by weight of material in the second turbulator relative to that in the first turbulator is approximately 2.0 to 1.

8. The apparatus of claim 5 wherein the amount of porous material in the second turbulator relative to that in the first turbulator is within the ratio range of 1.5 to 1 and 2.5 to 1 by weight.

9. Apparatus for generating a thoroughly mixed fluid including:

a fluid inlet;

a fluid outlet;

a first expansion turbulator connected to the inlet and having means for generating a turbulence in a fluid flowing through the first expansion turbulator;

relatively quiescent flow path expansion means for receiving fluid which has traversed the first expansion turbulator, and a second expansion turbulator in fluid communication with the flow path expansion means, including means for generating a turbulence in the fluid flow therethrough, said second expansion turbulator being in fluid communication with the fluid outlet, said second expansion turbulator having a larger cross-sectional dimension than the flow path expansion means, and said second expansion turbulator also having a larger cross-sectional dimension than the first expansion turbulator.

10. The apparatus of claim 9 wherein the turbulence generating means in the first and second expansion turbulators comprises a porous material having a plurality of interstices which are of ramdom size and orientation relative to the general direction of fluid travel through each expansion turbulator.

11. The apparatus of claim 10 wherein the weight of the second expansion turbulator turbulence generating material is larger than the weight of the first expansion turbulator turbulence generating material.

12. The apparatus of claim 10 wherein the amount by weight of porous material in the second expansion turbulator relative to that in the first expansion turbulator is approximately 2.0 to 1.

13. Apparatus for mixing air, soap, and water to create a washing foam comprising a water source;

a soap source;

an air source;

means for combining air, water, and soap from the respective sources to form a combined, but relatively unmixed, fluid;

first passage means for conducting such a relatively unmixed fluid in a relatively quiescent flow to a foam generating apparatus;

first foam generating means, operatively connected to the first passage means, for relatively turbulent passage of such a combined fluid;

second foam generating means through which the fluid must pass in relatively turbulent passage after passing through the first foam generating means;

expansion chamber means interconnecting the first and second foam generating means for directing foam from the first to the second foam generating means while allowing expansion of such foam therebetween;

means for exhausting the foam from the second foam generating means to an applicator; and each of the first and second foam generating means includes expansion chamber means having cross-sectional areas greater than that of the first passage means and also greater than that of the expansion chamber means interconnecting the first and second foam generating means, and means forming a plurality of randomly sized and oriented interstices through which the fluid must pass as it traverses each of the foam generating means, the internal volume of the second foam generating means being larger than the internal volume of the first foam generating means, and the amount of the interstices forming means being approximately the same in each foam generating means relative to the the respective internal volumes of the foam generating means.

14. The apparatus of claim 13 including means for altering the direction of flow of the combined fluid as the fluid leaves the first passage means and enters the first foam generating means comprising means for turning the fluid through a relatively sharp turn of approximately 90° immediately adjacent to and on the upstream side of the first foam generating means.

15. A foam generator comprising a first expansion chamber having a uniform cross-sectional area and a predetermined volume and including an inlet and an outlet;

a second expansion chamber, having a uniform cross-sectional area and a predetermined volume, in fluid communication with said outlet;

a third expansion chamber, having a uniform cross-sectional area and a predetermined volume which is greater than the predetermined volume of the first expansion chamber, in fluid communication with said second expansion chamber; each of said second and third expansion chambers being so structured in volume and cross-sectional area as to allow foam entering the chamber to expand from the preceding chamber, during steady state operation of the foam generator, and said first expansion chamber being so structured in volume and cross-sectional area as to allow fluid entering it to expand from the inlet;

means in said first and third expansion chambers for turbulently mixing any fluid flowing therethrough; and said first, second, and third expansion chambers being so arranged as to allow unidirectional flow therethrough.

16. The generator of claim 15 wherein the arrangement of said expansion chambers is such that fluid entering said inlet travels vertically upward through said first, second, third chambers.

17. The foam generator of claim 15 or 16 including means for forcing fluid exiting said inlet and entering said first expansion chamber through a turn of approximately 90° within said first expansion chamber.

18. The foam generator of claim 15 or 16 wherein said turbulent mixing means comprises material resembling a pot and pan scrubbing pad.

* * * * *